US007825313B2

(12) United States Patent
Shaffer

(10) Patent No.: US 7,825,313 B2
(45) Date of Patent: Nov. 2, 2010

(54) STRINGED MUSICAL INSTRUMENT NECK ASSEMBLIES

(75) Inventor: John Shaffer, Reno, NV (US)

(73) Assignee: Optek Music Systems, Inc., Reno, NV (US)

( * ) Notice: Subject to any disclaimer, the term of this patent is extended or adjusted under 35 U.S.C. 154(b) by 0 days.

(21) Appl. No.: 12/196,613

(22) Filed: Aug. 22, 2008

(65) Prior Publication Data

US 2008/0302228 A1 Dec. 11, 2008

Related U.S. Application Data

(63) Continuation of application No. 11/692,050, filed on Mar. 27, 2007, now Pat. No. 7,427,707.

(60) Provisional application No. 60/767,432, filed on Mar. 27, 2006.

(51) Int. Cl.
*G10D 3/00* (2006.01)

(52) U.S. Cl. ..... 84/293; 84/646

(58) Field of Classification Search ..... 84/293, 84/291, 646

See application file for complete search history.

(56) References Cited

U.S. PATENT DOCUMENTS

| | | | | |
|---|---|---|---|---|
| 3,854,370 | A | 12/1974 | Sapinski | |
| 3,943,815 | A * | 3/1976 | Gilbert | 84/293 |
| 3,958,113 | A | 5/1976 | Termohlen | |
| 4,915,005 | A | 4/1990 | Shaffer | |
| 4,981,064 | A * | 1/1991 | Vogt | 84/314 R |
| 5,266,735 | A | 11/1993 | Shaffer | |
| 5,408,914 | A | 4/1995 | Breitweiser, Jr. et al. | |
| 6,025,550 | A | 2/2000 | Kato | |
| 6,051,766 | A * | 4/2000 | Taylor | 84/293 |
| 6,120,910 | A | 9/2000 | Szenics | |
| 6,191,350 | B1 * | 2/2001 | Okulov et al. | 84/646 |
| 6,337,433 | B1 | 1/2002 | Nishimoto | |
| 6,452,081 | B1 | 9/2002 | Ravagni et al. | |
| 6,657,113 | B2 | 12/2003 | Herman | |
| 6,781,049 | B2 | 8/2004 | Taylor | |
| 2005/0126365 | A1 | 6/2005 | Shaffer | |

FOREIGN PATENT DOCUMENTS

| | | |
|---|---|---|
| JP | 09 006331 | 1/1997 |
| JP | 09006331 A * | 1/1997 |

* cited by examiner

*Primary Examiner*—Jianchun Qin
(74) *Attorney, Agent, or Firm*—Finnegan, Henderson, Farabow, Garrett & Dunner, LLP

(57) ABSTRACT

Described herein are fingerboards and neck assemblies for use with stringed musical instruments. The neck assembly can include a light-system disposed therein. The light system has a light matrix of light elements. The fingerboard is adapted to conceal the presence of the light elements when the light elements are not illuminated and to allow the passage of at least some illumination from the light elements when the light elements are illuminated.

22 Claims, 8 Drawing Sheets

STRINGED MUSICAL INSTRUMENT NECK ASSEMBLIES

CROSS-REFERENCE TO RELATED APPLICATIONS

This application is a Continuation of U.S. patent application Ser. No. 11/692,050, filed Mar. 27, 2007 (now U.S. Pat. No. 7,427,707), which claims priority to U.S. Provisional Application No. 60/767,432, filed Mar. 27, 2006. The entirety of all the above-listed Applications are incorporated herein by reference.

BACKGROUND

Learning to play any instrument, and particularly stringed instruments such as a guitar, violin, banjo and the like, can be difficult and time consuming. In general, multiple strings must be pressed against a fingerboard or fingerboard at one or more finger positions disposed along a neck of the instrument. At the same time, one or more selected strings must be vibrated via plucking, strumming or bowing, and thus, producing a musical tone, note or chord. Fingerboards are generally used on stringed instruments such as violins and cellos, and do not visually indicate finger positions per se. Conversely, guitars, for example, do have visual indicators—known as frets—and thus use a fretboard. Nonetheless, regardless of the type of stringed instrument, finger positions must be memorized, one or more strings pressed at those positions against a fretboard (used herein forward interchangeably with "fingerboard"), and selected strings caused to vibrate.

Although mastering stringed instruments can be accomplished through employing instructors and/or utilizing self-teaching books and automated chord charts, among other means, it is time-consuming and arduous. A student generally must translate diagrams from paper or a computer screen to locations of finger positions along the fingerboard. Next, the student must determine which strings to vibrate. Further, because a single note or cord can be played using one of several different finger positions and/or strings, the student must then determine which of those positions is most beneficial in a sequence of notes or chords according to a song or tune.

Some attempts have been made to facilitate the learning process. One attempt has been to provide a fingering display apparatus that has one or more holes bored through a fretboard through which illuminated lights are visible even when not illuminated. Unfortunately, the bores were difficult to create, and often damaged or negatively impacted the strength of the neck, as well as its tonal qualities. The neck of the instrument could flex creating the need for frequent adjustments. Further, the bores required a cover or cap causing visible indications that the instrument had been altered. Moreover, the user could see the lights through the cover or cap. Thus, it was apparent that the instrument was a "learning" instrument.

Another attempt incorporated a "stick" on display having small lights. Much like the attempt described above, the lights could illuminate according to certain finger positions. But the display caused difficulties as it affected the tactile feel of the fingerboard, could slip in position, and was difficult to place on a neck of the instrument.

With those and other drawbacks in mind, it is apparent that while the light-system sub-displays are useful, there are no means to inexpensively employ them, no means to preserve the integrity of the instrument, and no means to hide the system from observers.

Thus, one object of the invention is to provide stringed musical instrument neck assemblies that are useful as learning tools, and are inexpensive and substantially non-detectible. Another object is to provide necks assemblies for such instrument that have a light-system along the fingerboard. Another object is to provide neck assemblies with fingerboards that do not negatively affect the integrity or tonal characteristics of instruments and that can provide a tactile feel substantially as that of an instrument using a non-modified fingerboard.

SUMMARY

Described herein are methods and devices for illuminating stringed instruments. In one aspect, the instruments can include neck assemblies comprising a fingerboard and light elements. The neck assembly can further comprise a light-system including multiple light elements and/or an instrument neck configured to support the fingerboard. The fingerboard can be an elongated structure, generally of a size and shape to be mounted or coupled to an instrument neck. Light elements that can be illuminated by the light-system, and are visible from the top surface when illuminated but otherwise substantially concealed. The fingerboard with the light-system is disposed on an instrument neck that is manufactured or coupled to an instrument body.

In one embodiment, the fingerboard has areas of high and low light transmission. For example, an area of high light transmission can be positioned adjacent to light elements to allow the passage of light from the light elements. Conversely, an area of low light transmission can be positioned adjacent to the high light transmission area to limit light diffusion. Where the location of illumination represents a finger position, the low light transmission area can reduce the effect of light "spill over" to non-finger position portions of the fingerboard.

In one aspect, the difference in light transmission is achieved by varying the thickness of the fingerboard. For example, a portion of the finger board above a light can have an area of reduced thickness created by a well or recess in the fingerboard. In another aspect, the optical properties of the fingerboard can be varied. Different materials and/or additives can be used to form the low or high transmission portions of the fingerboard.

In a related aspect, a light-system and its light elements can be disposed on a substrate that is adapted to mate and/or couple to the bottom side of the fingerboard. The combined fingerboard and substrate can be disposed on the instrument neck. For example, the substrate can be sandwiched between a fingerboard and an instrument neck.

The substrate can include surface areas (e.g., bonding areas) that are adapted to facilitate bonding with the fingerboards. In one example, adhesives and/or glues can bond the surface of the substrate with the fingerboard.

The substrate can be sized and shaped to be at least partially received within a recess in the bottom side of the fingerboard, and thus, in one aspect, is substantially concealed by that fingerboard when disposed on an instrument neck. Light elements can be arranged on, in or through the substrate to substantially align with or within the wells of the fingerboard.

According to another related aspect, light elements can have one or more light devices, each device capable of producing one or more colors of illumination when energized by the light-system. Each color can represent an action to be taken, or a particular finger or fingers to be used, by a player of the instrument in addition to providing a visual indication of a finger or note position along which a string should be engaged by the player.

According to a further aspect of the invention, fretboards are provided that can be used for stringed musical instrument neck assemblies. Channels are disposed along a top surface of the fretboard, each channel extending in a direction substantially perpendicular to elongated sides of the fretboard, and having two opposing sides substantially perpendicular to the top side of the fretboard. An insert having a width slightly larger than width of a respective channel is disposed in a respective channel, and creates a force on the opposing sidewalls. The inserts have a secondary channel adapted to receive a fret.

According to a still further aspect of the invention, acoustical stringed instruments are provided having a mounting block that can couple neck assemblies to acoustical instrument bodies. The acoustical body has a generally hollow interior defined by a top side, a bottom side and a sidewall extending therebetween. The sidewall has an exterior side defining a recessed area along a portion thereof. The mounting block is shaped to couple to the side along a portion of the recess area. A top surface of the mounting block is adapted to receive and secure a portion of a bottom surface of the neck assembly. An aperture extending through the side provides passage for wires or a circuit to connect to a light-system in a fingerboard of the neck assembly to pass into the interior of the instrument body. The aperture is substantially concealed with the acoustic instrument is assembled.

In a related aspect, bores are disposed through the mounting block and extend through a bottom surface and the top surface. Mounting anchors can be received through the bottom surface extending through the bores and beyond the top surface. The neck assembly is adapted to receive the mounting anchors and be secured to the top surface. Mounting anchors can be bolts, screws or rivets. A mounting plate can be disposed on the bottom surface and has holes corresponding to the bores. The mounting plate can receive the mounting anchors providing a substantially rigid surface against which they can be tightened.

According to another aspect of the invention, a channel can extend along a portion of the acoustical instrument body and receive a portion of the fingerboard extending beyond a body end of the instrument neck. The channel extends in a direction substantially parallel to the neck assembly when disposed on the mounting block toward a center of the instrument body. It is sized and shaped to receive a portion of the fingerboard providing a smooth transition of the extending portion of the fingerboard along the channel. An aperture is disposed along the channel that provides passages of wires coupled to a light-system in the fingerboard to pass into the interior of the acoustical body, and is substantially concealed when the instrument is assembled.

BRIEF DESCRIPTION OF THE DRAWINGS

Additional benefits and advantages of the present invention will become apparent to those skilled in the art to which this invention relates from the subsequent description of preferred embodiments and the appended claims, taken in conjunction with accompanying drawings, in which:

DETAILED DESCRIPTION OF EXEMPLARY EMBODIMENTS

Figure 1:
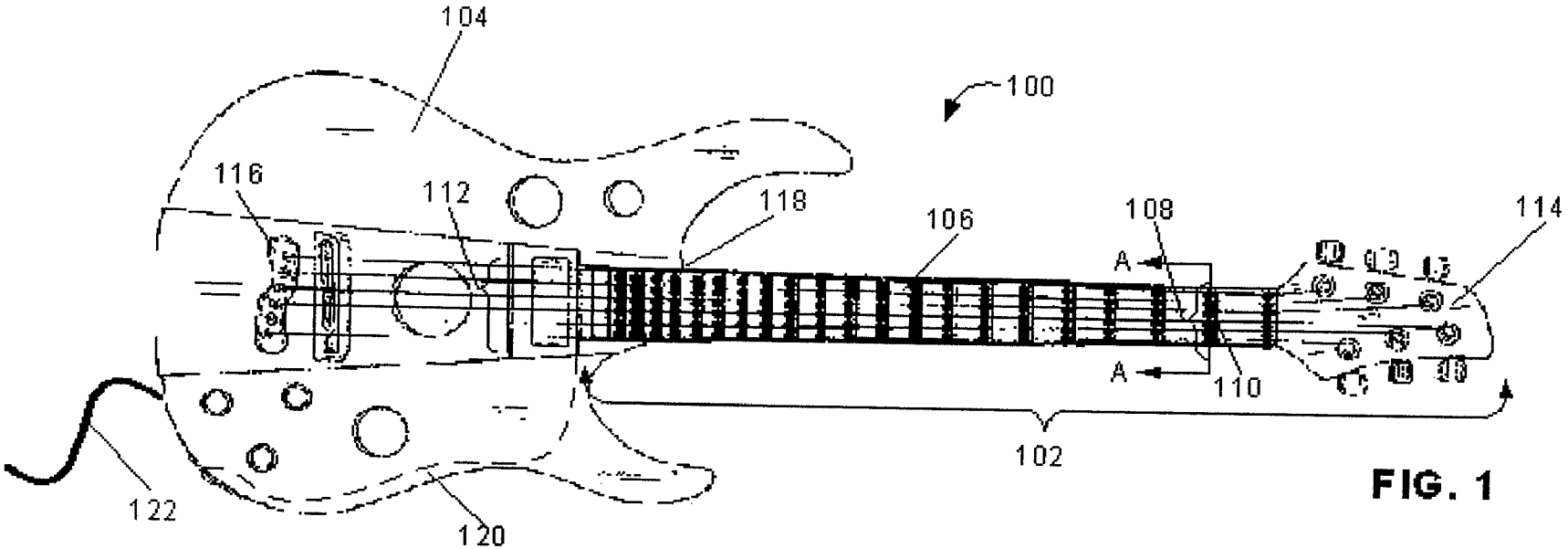
FIG. 1 is a stringed musical instrument having a neck assembly according to the invention with a fingerboard with a light-system having light element and disposed on an instrument neck; the neck assembly coupled to an instrument body.

Described herein are fingerboards and neck assemblies for use with stringed musical instruments. The neck assemblies can include a light-system for illuminating positions along the fingerboard providing a player of the instrument with visual indications of finger positions to be played. In general, a fingerboard is an elongated structure sized and shaped to be positioned on an upper surface of an instrument neck. Finger positions are disposed along a top surface of the fingerboard where a player can engage strings in the normal course of playing the instrument. The light-system has light elements in proximity to the finger positions. A light element can produce illumination in one or more colors when energized by the light-system, and its illumination is visible through the top surface of the fingerboard, but otherwise light elements are concealed. Because the light elements are disposed in proximity to the finger positions, e.g., beneath the finger positions, the player of the instrument receives a visual indication of which finger position to engage.

Neck assemblies can be used with electric instruments, e.g., electric guitars, and also acoustical instruments, e.g., acoustic guitars and violins. A mounting block provides means for coupling neck assemblies having fingerboards with light-systems to acoustical instruments, as well as to provide means for passing electrical wires coupled to the light-system through to an interior of the acoustic body.

Advantageously, illumination from energized light elements is visible to a player of the instrument through a top surface of the fingerboard, but the light elements are otherwise concealed when not energized. Because the light-system can preferably receive command inputs in near real-time, finger positions can be illuminated in near real-time. Thus, a player of the instrument can follow-along with music played at a proper tempo or any other desirable tempo. Alternatively, the light-system can have features such as pause, hold, loop, repeat, fast forward and rewind, or other features, that can allow a student to study finger positions over a period to time. The light-system, however, is concealed by the fingerboard which appears as an ordinary fingerboard upon casual inspection. Thus, visual attributes of the instrument are not substantially disturbed, and an audience is not alerted to the fact that the instrument has a light-system (unless the lights of the light system are illuminated). One light system suitable for use with neck assemblies such as the ones described herein is taught in U.S. patent application Ser. No. 5,266, 73S, "Music Training Instrument And Method, by John R. Shaffer, et al., issued Nov. 30, 1993, all the teachings of which are incorporated herein by reference.

In one embodiment, the fingerboard has areas of high and low light transmission. For example, an area of high light transmission can be positioned adjacent to light elements to allow the passage of light from the light elements. Conversely, an area of low light transmission can be positioned adjacent to the high light transmission area to limit light diffusion. Where the location of illumination represents a finger position, the low light transmission area can reduce the effect of light "spill over" to non-finger position portions or finger positions which should not be engaged or played of the fingerboard.

In one aspect, the difference in light transmission is achieved by varying the thickness of the fingerboard. For example, a portion of the fingerboard above a light can have an area of reduced thickness created by a well or recess in the fingerboard (described in more detail below).

In another aspect, the optical properties of the finger board can be varied. Different materials and/or additives can be used, to form the low or high transmission portions of the fingerboard. As referred to herein, "different materials" can include the same basic polymer (or other material) with different physical properties. During the manufacturing process different materials can be extruded or injection molded at different locations along the fingerboard. In another aspect, the fingerboard can be constructed in a two-step process where different materials are used in different steps. For example, the wells mentioned above can be filled with a translucent or transparent material thereby altering the luminescence and diffusion of the light source.

In another embodiment, directional light elements are used to reduce spill over. For example, the light elements can include directional LEDs that minimize dispersed light. Instead of wells, at least a portion of the fingerboard adjacent to the light elements can have a generally planer bottom surface. When illuminated, the directional light source can mark a finger position. In one example, LED's can vary in directional luminescence and can have anywhere from 15 (wide) to 90 (narrow) degree viewing angles.

In one exemplary embodiment, the light elements can be positioned immediately adjacent to the bottom surface of the fingerboard. The majority of the light emitted by the light elements is directed through the fingerboard to illuminate a finger position.

In another aspect, such directional light source elements can then be "tuned" with respect to the viewing angle of the player. For example, finger positions farther away from a players view can have a brighter and narrower beam of light to compensate for the distance away from the players view while finger positions closer to a players view can have a more diffuse and wide beam. This allows the instrument to yield a varying light pattern and luminescence while appearing to the player as even and uniform. Tuning an instruments light pattern and luminescence can also provide for variations in a players ocular strength or visual impairments.

In one embodiment, as mentioned above, the fingerboard has openings disposed along a bottom side and wells extending from the openings toward, but not through the top surface. The light elements are disposed on a substrate and partially or exactly arranged such than when the fingerboard is positioned over the light elements, the light elements correspond to the wells. In one aspect, the light elements are at least partially disposed in respective wells, although not every well need have a corresponding light element, and indeed, not every light element need be disposed in well.

FIG. 1 illustrates an embodiment of a stringed instrument 100 having a body 104 and a neck assembly 102. The neck assembly 102 has a fingerboard 106 with a light-system and is positioned on an instrument neck 210 (FIG. 2) that provides support for the fingerboard 106 and light system, as well as supports strings 112 that extend from a tail end 114 of the neck 210 to a terminator block 116 on the body 104. The instrument neck 102 couples or mounts to the body 104 at a body end 118. Along the fingerboard 106 are finger positions, e.g., 110 that can be designated by frets, although a fingerboard need not have frets. The light-system has light elements represented in the figure by dots, e.g., 108, that can produce illumination when energized by the light-system, and when energized, the illumination is visible to a player of the instrument. Otherwise, the light elements are substantially concealed from view by the fingerboard 106.

Although the stringed instrument 100 is illustrated as a six-stringed electric guitar, but it can be virtually any stringed instrument having a body, a neck assembly and at least one string that can be engaged at a finger position along a fingerboard. Further, although the stringed instrument 100 is illustrated as having a fingerboard with frets, a fingerboard need not have frets and such is the case in many stringed instruments, e.g., violins and the like.

As illustrated, fingerboard 106 has a bottom side that has openings disposed in proximity to finger positions, e.g., 110, such as directly beneath or in proximity thereto. Wells extend from the openings toward but not through a top surface. The light elements, e.g., 108, are arranged on a substrate that can be coupled to the bottom side of the fingerboard such that each light element is received by a respective well.

In another embodiment, the light elements are positioned remotely from the wells. For example, the light elements can be spaced from the openings of the well. The fingerboard can be spaced from the light system to provide room between the wells and the light elements. For example, as mentioned above, the wells can be filled with a transparent or translucent material. The light from the light elements can shine through the filled wells and the top of the fingerboard.

While the wells are illustrated as extending perpendicularly from the neck of the instrument, in another aspect, the wells could be directional. When a user holds some stringed instruments, such as a guitar, the user looks at the fingerboard from an angle. The wells could be angled toward the lateral edge of the instrument to facilitate viewing by a user. In one aspect, the wells are angled, with respect to the bottom surface of the fingerboard or the neck of the instrument in the range of about 5 degrees to about 85 degrees. In another aspect, the angle of the wells is in the range of about 20 degrees to about 70 degrees.

The fingerboard with the light elements can be positioned on the instrument neck, and the instrument neck can be coupled or mounted to the body 104. Wires and/or cables 120 coupled to the light-system for communicating signals and/or providing power to the light-system are embedded or routed through the body 104, and connect or couple to external wires 122 for connecting the light-system to a processor or other equipment. In one embodiment, however, wireless communication is utilized, and in that case, such wires and cables can be omitted.

Figure 2:
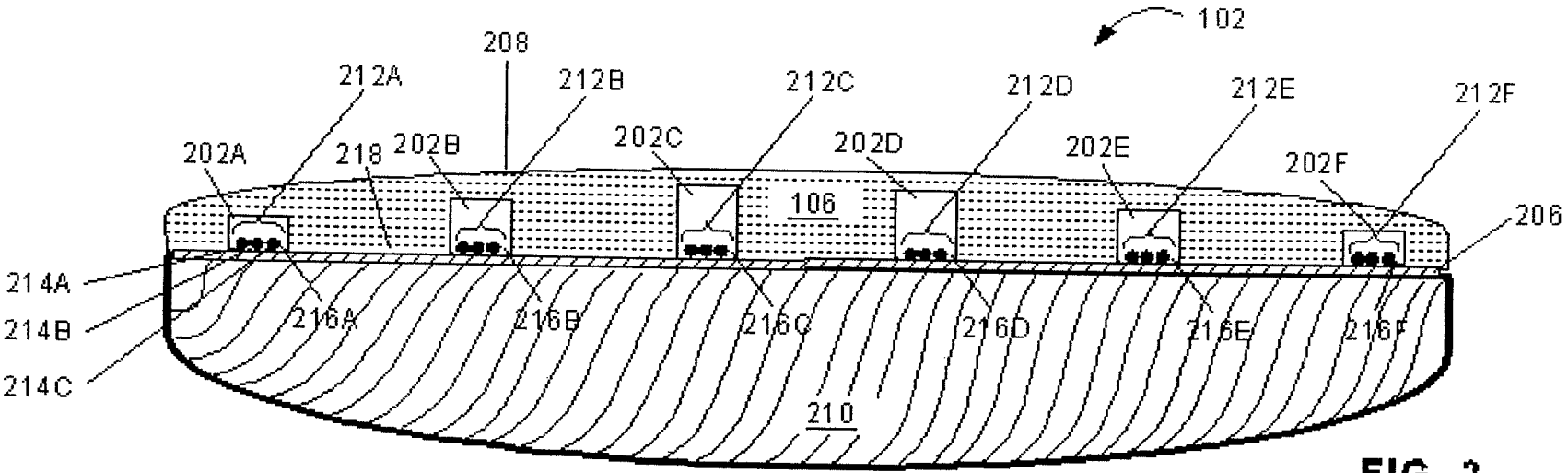
FIG. 2 is a cross-sectional view of the neck assembly of FIG. 1 shown light elements having a plurality of light devices, the light elements disposed on a substrate that is coupled to a bottom side of the fingerboard of FIG. 1 having wells that receive the light elements.

FIG. 2 is a cross-sectional view of the neck assembly 102 illustrated along axis A in FIG. 1, having a fingerboard 106, light elements 212 disposed on a substrate 206, and an instrument neck 210. Openings 216 are disposed along a bottom side 218 of the fingerboard 106 and are arranged to correspond to finger positions 110 along a top surface 208 of the fingerboard 106. Wells 202 extend from the openings 216 toward but not through the top surface 208, and can be sized and shaped to receive light elements 212. The light elements 212 are arranged on the substrate 206 according to the positioning of the wells 202, and thus, when substrate 206 is coupled to the fingerboard 106 each light element 212 is disposed in a respective well, e.g., light element 212A is disposed in well 202A.

It will be appreciated by those skilled in the art that the wells 202 illustrated correspond to fret 110 having six finger positions, namely, one finger position for each of the six strings 112 along fret 110. Of course, finger positions vary among stringed instruments, and wells need not be aligned along frets but rather, should be disposed in proximity to finger position of those other instruments. Thus, preferably, each well receiving a light element corresponds to a finger position of the intended instrument, whether the finger positions fall along a line or are staggered along the fingerboard of that instrument.

As illustrated, each light element 212 can have multiple light devices 214, each light device capable of producing illumination of one or more colors, although in another embodiment a light element can have a single light device capable of producing illumination in one or more colors. Light devices such as light emitting diodes (LEDs) are suitable for use herein because of their relatively low power consumption and cost, ease of manufacture and high availability, and longevity, including bi or tri-polar LEDs capable of producing illumination of varying color and/or intensities. However, it should be noted that any other suitable light source can be used for example, fiber optics, reflective mirrors, cathode ray tube, LCD, or plasma technology, etc. In the illustrated embodiment, light device 214A produces a red light, 214B produces a white light, and 214C produces a green light. Thus, a player can take a differing action at a finger position in response to a given color of light. For example, a red light can indicate to a player that its corresponding string should be played louder than the other strings. A white light can indicate to the player to take no special action with respect to that finger position. A green light can indicate to the player to slide the string back and forth while it is vibrating to produce a vibrato pitch. Of course, those are only examples and those skilled in the art will appreciate that multiple actions can be represented by multiple colored lights, or indeed, by a light if varying intensity. Further, a single light device can be used that is capable of producing various colors and/or intensity of light, and that could provide the same function. While the light element is generally described as emitting multiple lights, the light element can also be a single color, single source LED.

Figure 3A:
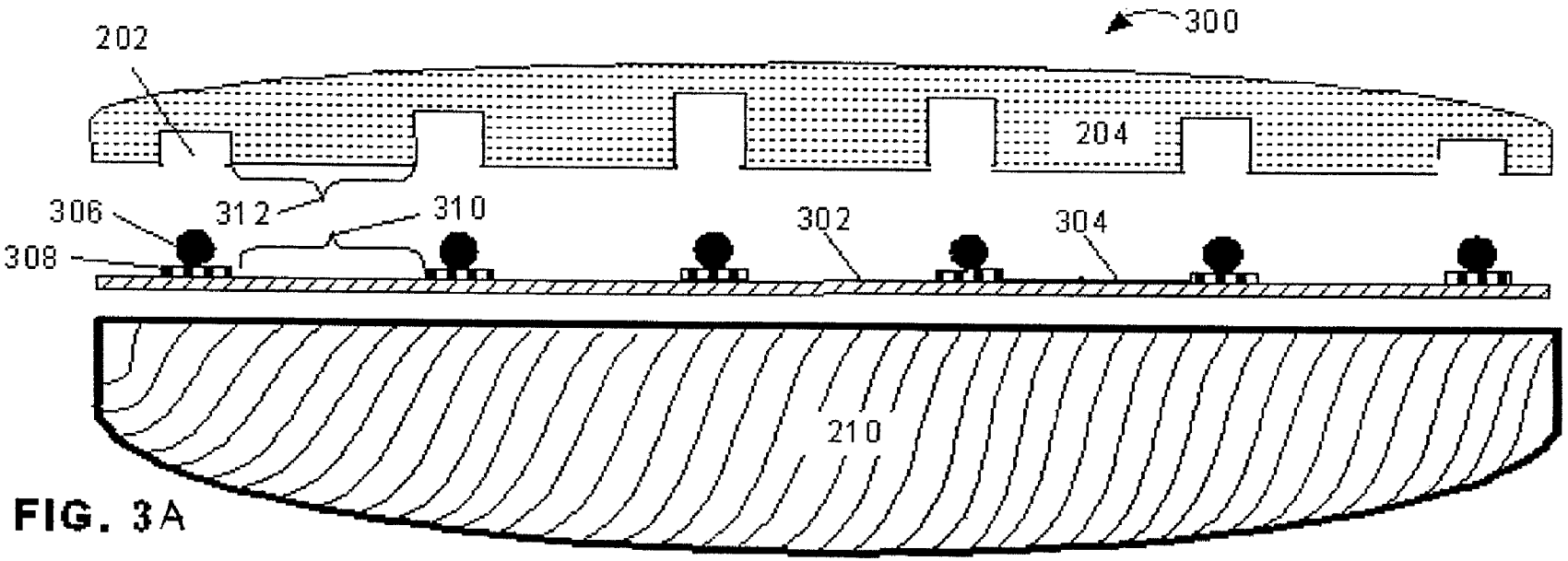
FIG. 3A is an exploded view of a neck assembly according to the invention having a light-system on a substrate that has channel that can receive adhesive and bond to a fingerboard.

FIG. 3A is an exploded cross-sectional plan of an embodiment of a neck assembly 300 having a fingerboard 204, a substrate 302, a light-system having light elements 306 disposed on the substrate 302, and an instrument neck 210. Fingerboard 204 is as generally described above and has wells 202 (FIG. 2) extending from a bottom surface toward but not through a top surface, the wells sized and shaped to receive a respective light-element 306. Substrate 302 is a substantially rigid and planer, and provides support for the light-system and light elements 306. Electrical lands 308 extending along the substrate 302 and provide power and/or electrical connections between the light-system and the light elements 306.

In one embodiment, substrate 302 can be bonded or glued or otherwise coupled to the bottom side of the fingerboard 204. In one embodiment, to increase bonding, channels 310 can be etched, ground or otherwise made on a top surface of the substrate 302 and are adapted to receive adhesive 304 that provides means for coupling the substrate 302 to the fingerboard 204. Channels 310, as illustrated in FIG. 3A, do not require a recessed area, but can instead comprise a planer surface or surface between the light elements of the light system.

It will be appreciated by those skilled in the art that the substrate 302 can be a circuit board. Depending on the choice of adhesives, the materials of the fingerboard, and/or the tendency of the fingerboard to distort, the substrate can be configured to enhance bonding. For example, coatings and/or other materials present on the surface of circuit boards can inhibit adhesive bonding with materials composed of polymers and/or polycarbonates, such as those used to manufacture fingerboards 204. For example, many circuit boards are constructed of a material having Fire Retardant 4 ("FR-4"). FR-4 is generally a woven fiberglass mat impregnated with a flame resistant epoxy resin. A coating is applied, commonly referred to as a solder mask that protects the fiberglass from being weakened or otherwise altered during manufacturing of electrical vias, lands and other features. Those coatings can be adverse to adhering with some glues and/or adhesives.

Removing or not applying a solder mask to a portion of the surface of a circuit board thus creating channels 310, each channel 310 corresponding to a portion 312 of the fingerboard 204. Adhesives 304 or glues can then be used to couple the circuit board to the fingerboard 204 and create a strong, durable bond therebetween. Alternatively, or together with the above, portions of the coating can be strategically placed such that the components and selected mounting areas of the circuit board are protected, while other areas where there are substantially no components, can be left free of the coatings.

In one embodiment, substrate 302 can be an electrically non-conductive substantially planer substrate having electrically conductive pads 308 disposed thereon. Electrical lands (not shown) can be disposed in channels 310 corresponding to portions 312 of the fingerboard can be defined by recessed areas between pads 308. Adhesive 304 can be applied to a portion or substantially all of a top surface of the substrate, and the pads, lands and light elements can be disposed thereon and bonded thereto. The substrate 302 can then be coupled to the fingerboard 204.

Figure 3B:
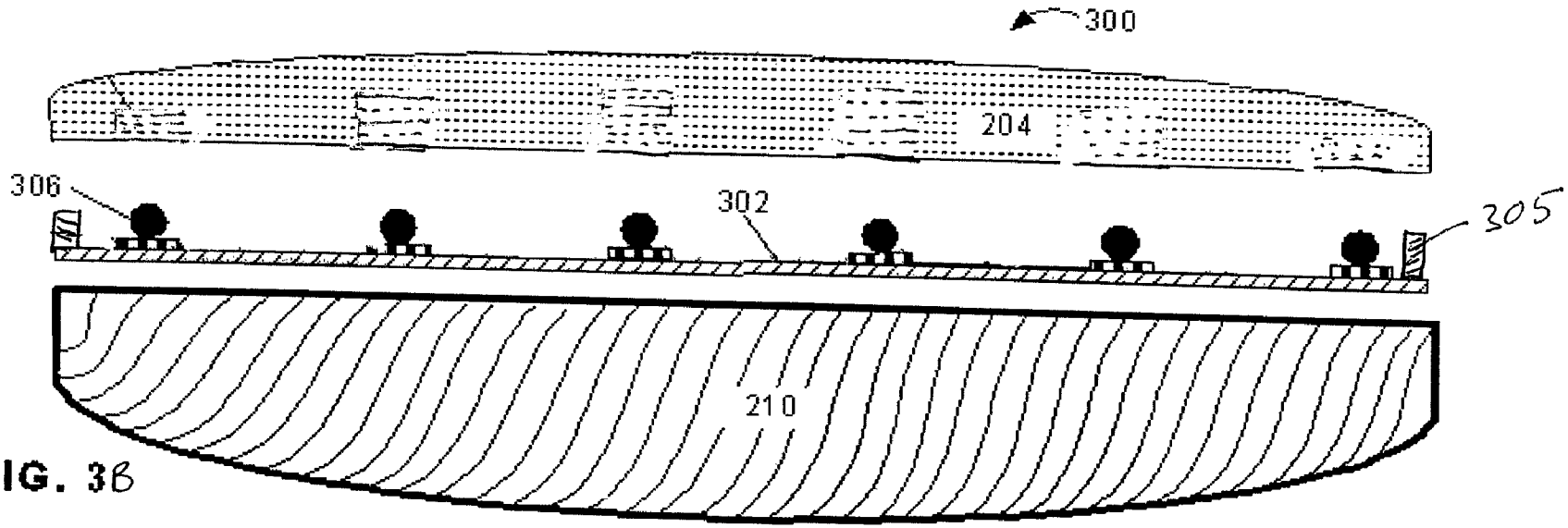
FIG. 3B is an exploded view of another embodiment of the neck assembly of FIG. 3A.

FIG. 3B illustrates another exemplary embodiment of fingerboard 204 without the use of wells 202. For example, the wells can be filled with a transparent or translucent material or no wells (or fewer wells than light elements) can be formed. A spacer 305 can be positioned between the fingerboard and the substrate and/or instrument neck to provide room for the light elements. The spacer can be formed integrally with a portion of the neck assembly and/or defined by a separate structure. For example, a portion of the fingerboard can define the spacer, a portion of the substrate can define the spacer, a portion of the instrument neck can define the spacer, and/or a separate structure can be placed adjacent to the fingerboard to provide room for the light elements.

In another embodiment, the light elements and/or substrate can be recessed in the substrate and/or instrument neck to provide room for the light elements. For example, instead of wells in the fingerboard, the neck can include a recessed area in which the substrate is disposed. Alternatively, individual light elements can be disposed within wells in the substrate and/or instrument neck. In still another embodiment, the light elements can be substantially flat and no spacer or recess is required.

Figure 4:
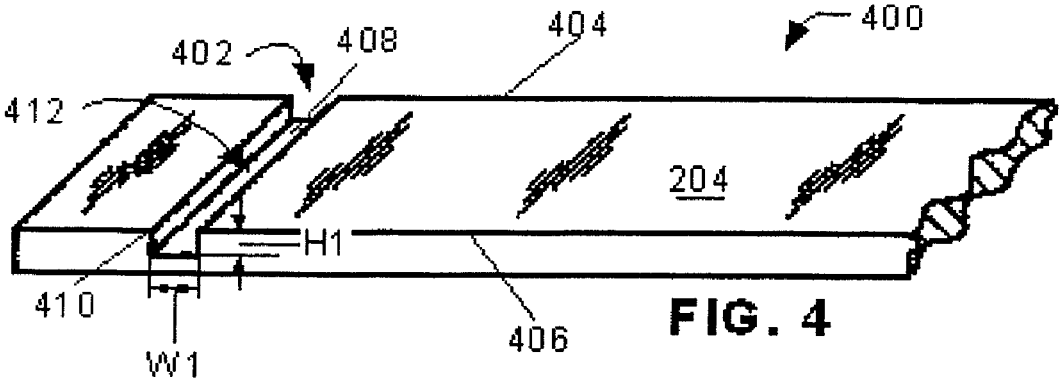
FIGS. 4-6 show a fretboard according to the invention having a channel that receives an insert, the insert having a secondary channel that can receive a fret.
Figure 5:
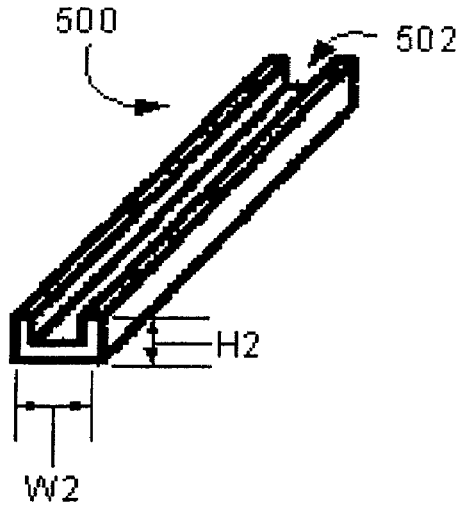
Figure 6:
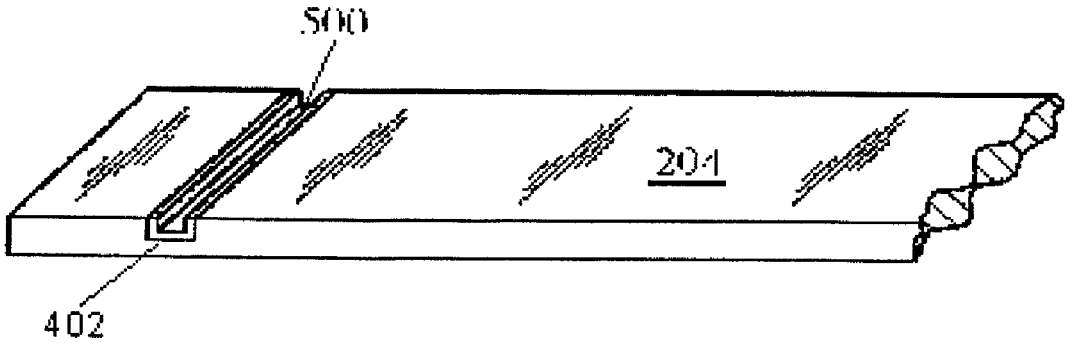

FIGS. 4, 5 and 6 in conjunction show a portion 400 of a fingerboard 204 (FIG. 4) having a channel 402 that can receive an insert 500 (FIG. 5) which in turn, can receive and secure a fret or other insignia. Channel 402 is disposed along the fingerboard 204 extending substantially between elongated sides 404, 406 of the fingerboard 204. Channel 402 has a bottom side 408 having a width W1, and two opposing sides 410, 412 that are substantially perpendicular to the top side of the fingerboard 204 and have a height H1. Channel 402 is disposed along the fingerboard 204 in proximity to finger positions corresponding to a fret, however, in one embodiment channel 402 can be disposed along the fingerboard 402 to receive insignia or other decorations and need not be in proximity to one or more finger positions.

The fingerboard 204 is as generally described above having an elongated body sized and shaped for placement on an instrument neck of a stringed musical instrument, and has a top surface and a bottom surface. The bottom surface has a plurality of openings and wells extending from the openings toward but not through the top surface. Light elements of a light-system can be received by the wells, and illumination of energized light elements is visible to a player of the instrument, but otherwise substantially concealed.

In another embodiment described herein, the fingerboard can include inserts to facilitate mating of the frets with the fingerboard. Insert 500, as shown in FIG. 5, is sized and shaped to be received by a channel 402, and has a secondary channel 502 that is adapted to receive a fret 110 (FIG. 1). Insert 500 has a width W2 that is slightly larger that than the width W1 of the channel 402 thereby creating a pressure on opposing sides 410, 412 of the channel 402 when disposed therein. In another aspect, the placement of frets within insert 500 causes the insert to assume a width greater than the width of channel 402. Regardless, insert 500, or insert 500 with a fret, can have a width the results in pressure applied on the fingerboard. Further, insert 500 can also have a height H2 that is equal to or less than the height H1 of the channel. FIG. 6 shows insert 500 disposed in channel 402.

It has been found that disposing channels 402 along fingerboard 204 causes the fingerboard 204 to bow or otherwise distort. Advantageously, by providing inserts 500 such as the ones described here, a pressure is produced on the opposing sides 410, 412 of the channels 402. That pressure can restore the fingerboard 402 to substantially its original planer shape. The pressure necessary can be varied by sizing the width W2 with respect to the width W1 of the channel, e.g., a larger difference between W2 and W1 corresponds to a larger pressure. In addition, or alternatively, the amount of pressure can be chosen by varying the materials used to construct insets 500. Of course, there is a limit to the difference between W2 and W1 depending on the ability of the insert to be disposed within the channel 402.

Further, and also advantageously, inserts 500 have a secondary channel 502 providing means for using frets that are commonly used in the construction of fingerboards. It will be appreciated by those skilled in the art that commonly used frets can have an anchor portion having locking fins or a tang, that is generally forced into a channel along a fretboard. But those fretboards are constructed of materials such as wood that has an ability to deform and secure the fret. Unfortunately, the fingerboards described here are constructed of polymers and/or polycarbonates that, depending on the properties of the polymer, can inhibit securement of frets. Insert 500 can be made of a differing material, e.g., wood, and the above noted problem is overcome by disposing the secondary channel 502 in the insert 500 which is elastic and/or compressible and can deform to receive and secure the fret.

Figure 7:
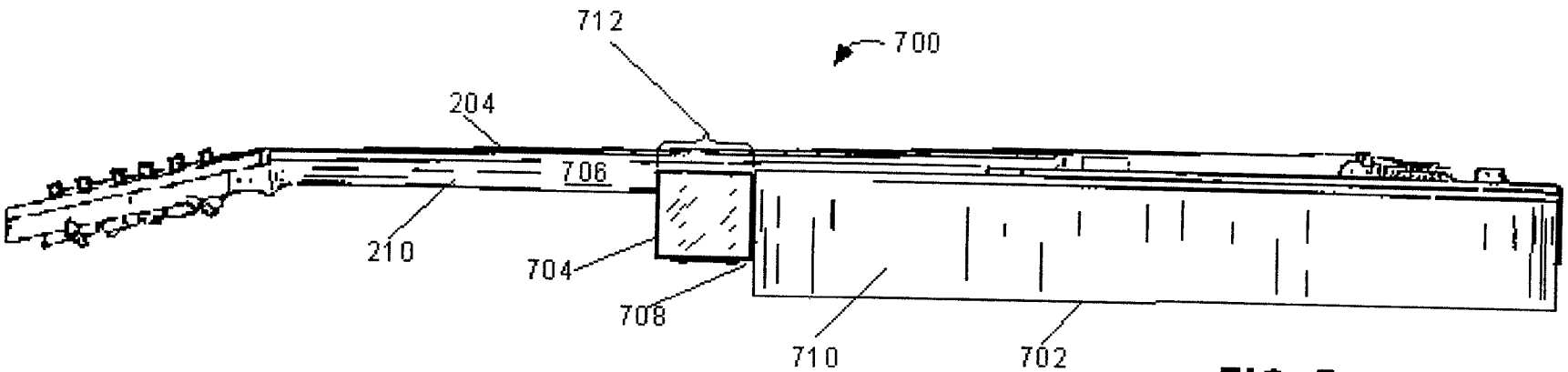
FIG. 7 illustrates an acoustical stringed musical having a mounting block coupled to an acoustical body and a neck assembly.

FIG. 7 illustrates an acoustic stringed instrument 700 having an acoustical body 702 coupled to a neck assembly 706 via a mounting block 704. The neck assembly 706 has a fingerboard 204 with a light-system, and an instrument neck 210, both as generally described above, and has a surface portion 712 along a bottom surface that can couple to the mounting block 704. Mounting block 704 has a shape configured to couple to a recessed area 708 along a sidewall 710 of the acoustic body 702, and is adapted to receive the surface portion 712 of the neck assembly 706. For example, the mounting block can have a shape corresponding to at least a portion of recess area 708. While mounting block 704 is described as a single piece structure, in an alternative aspect, the mounting block could be defined by several individual body. In addition, the mounting block can be formed by a variety of materials in addition to, or as an alternative to wood. For example, a portion or the whole of the mounting block can be formed of a polymer, elastomer, or metal.

Thus, mounting block 704 can couple the neck assembly 706 to the acoustic body 702 allowing a light-system to be used with acoustical instrument without substantially, or in one embodiment without noticeably affecting the tonal characteristics of the assembled instrument. Alternatively, or additionally, mounting block 704 provides means for easily manufacturing acoustical stringed instruments having light systems.

Figure 8:
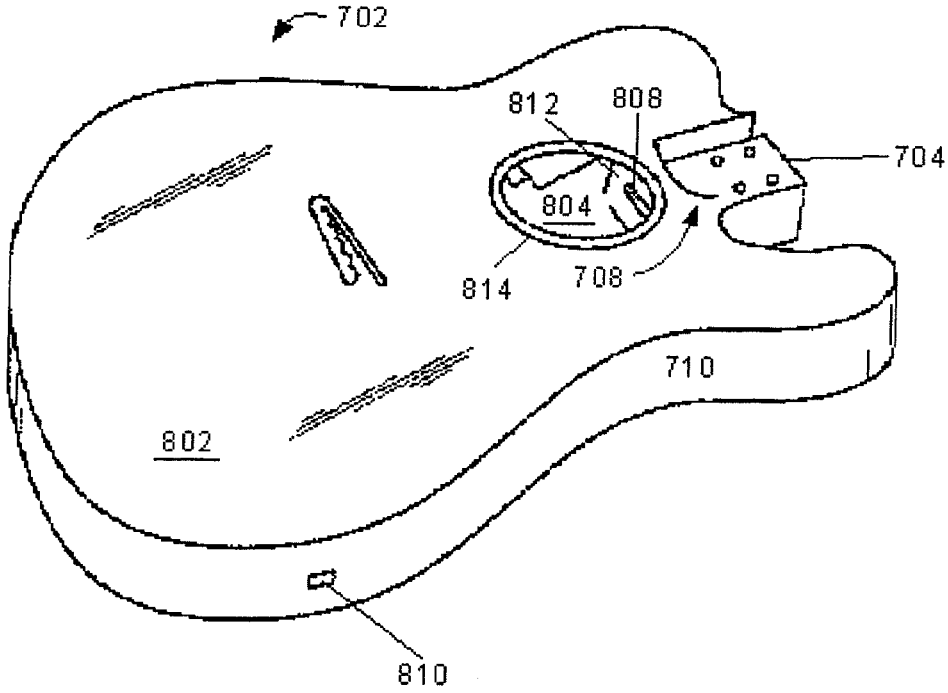
FIG. 8 shows the mounting block coupled to the acoustical body as illustrated in FIG. 7.

FIG. 8 is a top plan of the acoustic body 702 of FIG. 7. Acoustic body 702 has a generally open interior defined by a top surface 802, a bottom surface 804 and the sidewall 710 extending therebetween. The sidewall 710 has an outer surface that defines the recessed area 708, and the mounting block 704 is shaped to couple to a portion of the sidewall 710 along the recessed area 708. Although the acoustic body 702 has an open interior defined, inter alia, by a sidewall, it will be appreciated by those skilled in the art that an acoustic body can have a plurality of sidewalls forming a continuous wall between the top and bottom surface, and indeed, an acoustic body can have a plurality of walls with spaces therebetween, or even an outer sidewall and one or more inner sidewalls.

An aperture 808 extending through the sidewall 710 along the recessed area 708 provides passage for wires 120 (FIG. 1) coupled to the light-system in the fingerboard 204 to enter the interior of the body 702 and couple to a connector 810. Aperture 808 is positioned such that its exterior opening is concealed by the neck assembly 706 when the instrument 700 is assembled.

A reinforcement block 812 can be disposed in the interior of the body 702 opposite the mounting block 704 to provide structural support for the mounting block 704. The mounting block 704 can be screwed or otherwise coupled to the reinforcement block 812 through the sidewall 710 using a variety of means. Reinforcement block 812 can be coupled to an interior surface of the sidewall 710, as well as glued or other attached to an interior surface of the bottom side 804 of the body 702.

The acoustic body 702 illustrated has a sound hole 814, however, acoustic bodies can have other openings into the interior, e.g., F-holes as is common in many stringed instruments. Indeed, acoustic body 702 can have a plurality of sound holes, as is generally common for acoustic instruments.

Figure 9:
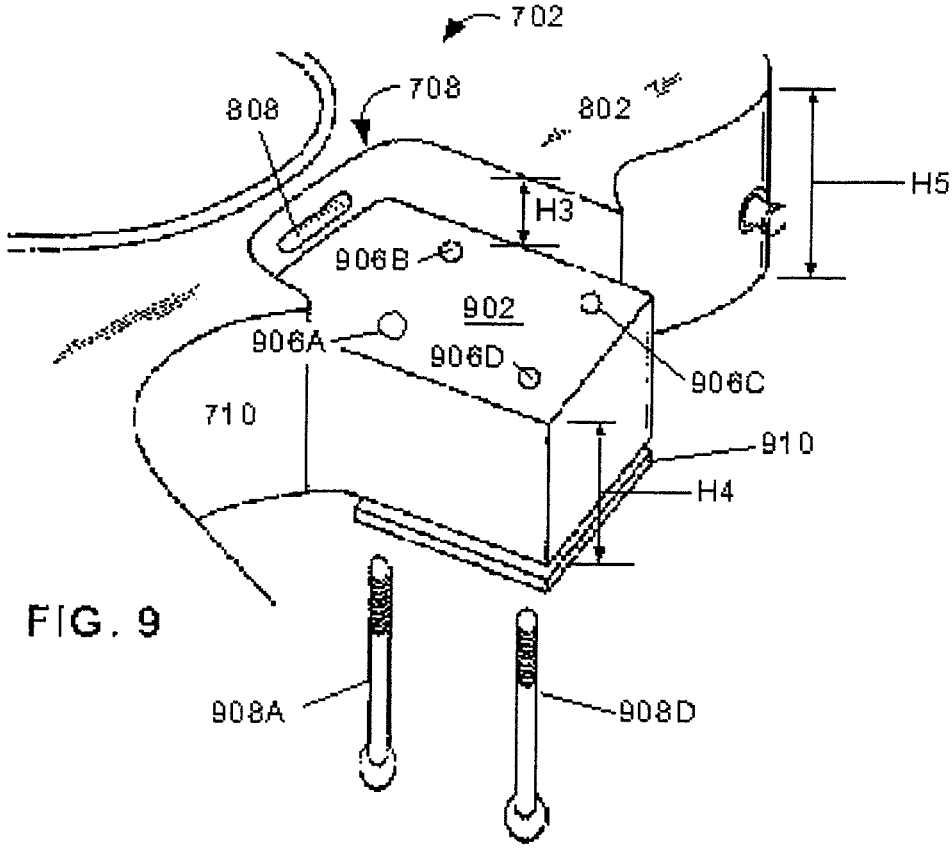
FIG. 9 is an exploded view of the mounting block illustrated in FIGS. 7 and 8.

FIG. 9 is a detailed view of the mounting block 704 coupled to the sidewall 710 along the recessed area 708. Mounting block 704 has one or more sides sized and shaped to couple with the sidewall 710 along the recessed area 708. Mounting block 704 has a height H4 that is preferably less than a height H5 of the sidewall 710, thus accommodating a smooth transition of the fingerboard 204 and the acoustic body 702. Height H3 is thus selected to accommodate that transition, and is selected according to the size and shape of the portion 712 of the neck assembly 706 that will be secured by the mounting block 704.

As described above, top surface 902 of the mounting block 704 is illustrated as substantially flat; however it can be shaped and sized to accommodate a wide variety of neck assemblies 706. For example, in a case where the portion 712 of the bottom side of the neck assembly 706 has a convex or more triangular shape, top surface 902 can have a corresponding shape, e.g., concave or inverted triangular shape, to accommodate the neck assembly 706, and other shapes and designs are envisioned.

Bores 906 can extend through the mounting block 704 and can receive mounting anchors 908 such as bolts, screws or rivets. Additionally, adhesives and glue can add support for coupling the neck assembly 706 to the mounting block 704. Thus, the neck assembly 706 can be adapted to receive the mounting anchors 908 and be securely anchored against the top surface 902 of the mounting block 704. Care should be given to ensure that the light-elements are not damaged by the amounting anchors, e.g., the anchors, in one aspect, should not come in contact with the substrate 206 (FIG. 2) or light elements 212.

A mounting plate 910 can be a substantially rigid planer structure having holes aligned with the bores 906, and can receive the mounting anchors 908. Mounting plate 910 provides a structure against which the mounting anchors 908 can be tightened or secured. In one embodiment, the mounting block 704 has a design or shape that is not substantially block-like but rather has a curve or other features along its bottom side. In that case, the mounting plate 910 can have a shaped to provide a tight fit (e.g., a corresponding shape) when disposed on the bottom side of the mounting block.

Figure 10:
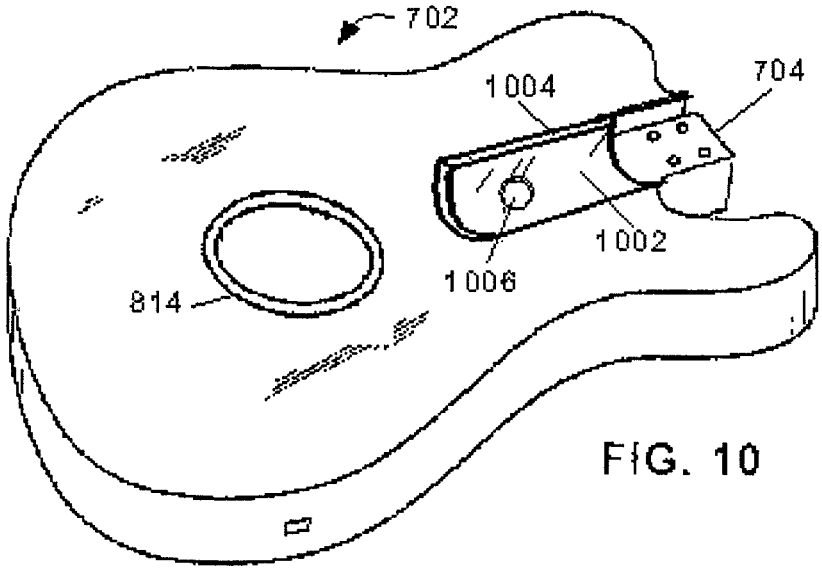
FIG. 10 shows an acoustical instrument body having a channel extending along a top surface that can receive a portion of a fingerboard having a light system that extends beyond a body end of an instrument neck.

FIG. 10 illustrates another embodiment of the acoustic body 702 illustrated above, having a mounting block 704 coupled along a sidewall in a recessed area, and a channel 1002 extending along the top surface in a direction substantially parallel to the neck when disposed on the mounting block 704, e.g., toward the sound hole 814. Channel 1002 is sized and shaped to receive an extended portion of a fingerboard 204, e.g., a portion extending beyond the body end 118 (FIG. 1) of the instrument neck assembly 706. It will be appreciated by those skilled in the art that acoustic instruments can have a fingerboard that extend along a distance of the acoustic body 702, and the embodiment illustrated in FIG. 10 can accommodate those types of instruments.

Channel 1002 can have sidewalls, e.g., 1004, that correspond in height to a height of the fingerboard, such that the fingerboard is equal in height with the top surface of the body 704. Alternatively, the channel and/or fingerboard can be configured to exceed the height of the instrument body top surface. An aperture 1006 is located along the channel 1002 and is sized and shaped to provide passage of the wires 120 coupled to the light-system into the interior of the body, and is positioned to be concealed when the instrument is assembled.

In another embodiment the hollow body or acoustic instrument can include a counter weight. The presence of a light system (e.g., light elements and/or associated wiring and circuitry) can increase the weight of an instrument neck. In order to balance the increased weight of the instrument neck, the body of the instrument can include a counter weight. In one aspect, acoustical body 702 can include counter weight material (e.g., wood, polymer, metal) along the inner surface of the sidewall 710. The mass of the counter weight can be chosen depending on the balance of the instrument; the type of instrument; the weight of the fingerboard, light system, and/or substrate; and/or the location of the counter weight. For example, additional wood, polymer, or metal counter weight can be mated with the inner surface of sidewall 710 opposite the instrument neck and/or the inner surface of the acoustical body 702 proximate to the lower portion of body 702.

Described above are stringed instrument having neck assemblies for use with a light-system and achieving desired objectives. It will be appreciated that the embodiments illustrated and discussed herein are but a few examples of the invention, and that other embodiments employing changes therein are within the scope of the invention, and are envisioned.

What is claimed is:

1. An acoustical stringed instrument comprising:

an acoustical instrument body, the body having an open interior defined by a top surface, a bottom surface, and a sidewall, the sidewall having an inner surface and an outer surface, a portion of the outer surface of the sidewall defining a recessed area;

a mounting block having a shape corresponding to at least a portion of the recessed area and coupled to part of the recessed area, the mounting block positioned between at least a portion of an instrument neck having a light-system and the recessed area, the light-system having an electrical wire coupled thereto;

a fingerboard having an elongated body and disposed on the instrument neck, the fingerboard having a bottom surface having a plurality of openings with wells extending from the openings toward but not through the top surface of the fingerboard, wherein the light-system has a plurality of light elements, each light element capable of producing illumination when energized by the light-system, wherein each light element is concealed beneath the top surface of the fingerboard that appears substantially uniform; and an aperture extending through the recessed area of the sidewall of the body, the aperture sized and shaped to provide passage of the wire of the light-system into the interior of the body, the aperture positioned such that it is concealed when the stringed instrument is assembled.

2. The stringed instrument of claim 1, further comprising: a reinforcement block disposed in the interior of the acoustic body, the reinforcement block having a shape corresponding to at least a portion of the interior surface of the sidewall and disposed opposite the mounting block.

3. The stringed instrument of claim 2, wherein the reinforcement block has an aperture extending therethrough, the aperture adapted to receive the wire of the light-system.

4. The stringed instrument of claim 1, wherein the top surface of the fingerboard is curved.

5. The stringed instrument of claim 1, wherein the plurality of light elements includes an element having a first color and an element having a second color that is different to the first color.

6. The stringed instrument of claim 1, wherein the top surface of the fingerboard includes a channel configured to receive an insert.

7. The stringed instrument of claim 6, wherein the insert is configured to receive a fret.

8. An acoustical stringed instrument comprising:

an acoustical instrument body, the body having an open interior defined by a top surface, a bottom surface, and a sidewall, the sidewall having an inner surface and an outer surface;

a mounting block having a shape corresponding to at least a portion of the sidewall and coupled to part of the outer surface of the sidewall, the mounting block including two or more bores extending from a bottom surface of the mounting block through a top surface of the mounting block, wherein each bore is sized to receive a mounting anchor;

an instrument neck having a light-system coupled to an electrical wire, wherein the instrument neck is adapted to receive two or more mounting anchors to be secured to the mounting block;

a fingerboard having an elongated body and disposed on the instrument neck, the fingerboard having a bottom surface having a plurality of openings with wells extending from the openings toward but not through the top surface of the fingerboard, wherein the light-system has a plurality of light elements, each light element capable of producing illumination when energized by the light-system, wherein each light element is concealed beneath the top surface of the fingerboard that appears substantially uniform; and an aperture extending through the sidewall of the body, the aperture sized and shaped to provide passage of the wire of the light-system into the interior of the body, the aperture positioned such that it is concealed when the stringed instrument is assembled.

9. The stringed instrument of claim 8, further comprising: a fingerboard having an elongated body and disposed on the instrument neck, the fingerboard having a bottom surface having a plurality of openings with wells extending from the openings toward but not through the top surface of the fingerboard; and the light-system having a plurality of light elements, each light element capable of producing illumination when energized by the light-system.

10. The stringed instrument of claim 8, further comprising a substantially rigid mounting plate disposed on the bottom surface of the mounting block, the mounting plate having holes disposed therethrough and arranged according to the bores extending through the mounting block, the mounting plate receiving the mounting anchors.

11. The stringed instrument of claim 8, further comprising: a reinforcement block disposed in the interior of the acoustic body, the reinforcement block having a shape corresponding to at least a portion of the interior surface of the sidewall and disposed opposite the mounting block.

12. The stringed instrument of claim 11, wherein the reinforcement block has an aperture extending therethrough, the aperture adapted to receive the wire of the light-system.

13. The stringed instrument of claim 8, wherein the top surface of the fingerboard is curved.

14. A stringed instrument comprising:

an instrument body, the body having an open interior defined by a top surface, a bottom surface, and a sidewall, the sidewall having an inner surface and an outer surface, a portion of the outer surface of the sidewall defining a recessed area;

a mounting block having a top surface, a shape corresponding to at least a lower portion of the recessed area, and coupled to part of the lower portion of the recessed area;

an instrument neck having a light-system coupled to an electrical wire, wherein the instrument neck has a shape corresponding to an upper portion of the recessed area and is coupled to the top surface of the mounting block;

a fingerboard having an elongated body and disposed on the instrument neck, the fingerboard having a bottom surface having a plurality of openings with wells extending from the openings toward but not through the top surface of the fingerboard, wherein the light-system has a plurality of light elements, each light element capable of producing illumination when energized by the light-system, wherein each light element is concealed beneath the top surface of the fingerboard that appears substantially uniform; and an aperture extending through the recessed area of the sidewall of the body, the aperture sized and shaped to provide passage of the wire of the light-system into the interior of the body, the aperture positioned such that it is concealed when the stringed instrument is assembled.

15. The stringed instrument of claim 14, further comprising: a fingerboard having an elongated body and disposed on the instrument neck, the fingerboard having a bottom surface having a plurality of openings with wells extending from the openings toward but not through the top surface of the fingerboard; and the light-system having a plurality of light elements, each light element capable of producing illumination when energized by the light-system.

16. The stringed instrument of claim 14, wherein the mounting block further comprises one or more bores extending from a bottom surface through the top surface, each bore sized to receive a mounting anchor.

17. The stringed instrument of claim 16, wherein the instrument neck is adapted to receive the mounting anchors and be secured to the mounting block.

18. The stringed instrument of claim 17, further comprising a substantially rigid mounting plate disposed on the bottom surface of the mounting block, the mounting plate having holes disposed therethrough and arranged according to the bores extending through the mounting block, the mounting plate receiving the mounting anchors.

19. The stringed instrument of claim 14, further comprising: a reinforcement block disposed in the interior of the instrument body, the reinforcement block having a shape corresponding to at least a portion of the interior surface of the sidewall and disposed opposite the mounting block.

20. The stringed instrument of claim 19, wherein the reinforcement block has an aperture extending therethrough, the aperture adapted to receive the wire of the light-system.

21. The stringed instrument of claim 14, wherein the stringed instrument includes an acoustical instrument.

22. The stringed instrument of claim 14, wherein the top surface of the fingerboard is curved.

* * * * *